United States Patent [19]

Hull et al.

[11] Patent Number: 4,993,159

[45] Date of Patent: Feb. 19, 1991

[54] NAILING SCHEDULE CENTER MARKER

[76] Inventors: Harold L. Hull, 401 Canyon Way #43, Sparks, Nev. 89434; Ronald W. Birmingham, P.O. Box 7664, Crystal Bay, Nev. 89450

[21] Appl. No.: 569,862

[22] Filed: Aug. 20, 1990

[51] Int. Cl.[5] ..... B43L 13/00

[52] U.S. Cl. ..... 33/41.3; 101/328; 33/42

[58] Field of Search ..... 33/35–38, 33/41.3, 39.1, 42; 101/328, 329, 330, 331

[56] References Cited

U.S. PATENT DOCUMENTS

| | | | |
|---|---|---|---|
| 283,583 | 8/1883 | Dorr | 101/330 |
| 448,264 | 3/1891 | Saxton | 101/330 |
| 1,723,046 | 1/1927 | Lerner . | |
| 2,237,228 | 8/1938 | Jobe . | |
| 2,451,595 | 2/1947 | Wheeler . | |
| 2,776,620 | 1/1957 | Quimby | 101/328 |
| 3,006,273 | 10/1960 | Sommer . | |
| 3,046,884 | 5/1960 | Pearson . | |
| 3,086,460 | 5/1961 | Denning . | |
| 3,537,394 | 11/1970 | Swapp . | |
| 3,546,779 | 6/1970 | Klein . | |
| 3,896,725 | 7/1975 | Grover . | |
| 3,988,835 | 11/1976 | Thornton . | |
| 4,372,049 | 2/1983 | Hogue . | |
| 4,794,857 | 1/1989 | Waters, Sr. . | |

*Primary Examiner*—Harry N. Haroian

[57] ABSTRACT

A marking apparatus is dislcosed which has a reversible rotating drum removably enclosed in a housing which has on its outer extremities, projections, which come into contact with a marking device at each revolution and the projection then deposits the marking fluid on a workpiece such as a 4×8 sheet so that a nailing schedule may be marked accurately around the edges and down the center of the workpiece.

16 Claims, 2 Drawing Sheets

NAILING SCHEDULE CENTER MARKER

FIELD OF THE INVENTION

This invention relates to marking devices and more particularly to marking devices used in the construction trades that call for a nailing schedule.

BACK GROUND OF THE INVENTION

In the past, prior art teachings have provided a number of marking devices for the construction trade which are primarily concerned with marking stud positions, joists, rafters, trusses and the like, such as U.S. Pat. Nos. 3,988,835 and 4,794,857 or the complicated U.S. Pat. No. 3,537,394. These and other similar devices consist basically of a roller with a handle, with the roller containing a reservoir of some type, generally within the roller in the form of pads, tubular markers, etc., and projections on the roller to come in contact with the surface to be marked. The projections are pre-determined and are at increments for a specific marking pattern which generally cannot vary.

SUMMARY OF THE INVENTION

The present invention relates to a marking apparatus particularly concerned with the nailing schedules required in modern day construction wherein the engineering prints call out a nailing schedule which must be met to insure that the load requirments will be met, namely, that the nails be placed a required distance apart from each other, such as 2, 3, 4 or 6 inches. When, for example, sheeting, or flooring panels, or siding panels are nailed, the nailing schedule calls for the panels, especially around the edges of the 4×8 foot sheets, to be nailed at pre-determined intervals and will be inspected by the building inspectors to make sure the nailing schedule is met. The inspector can and does require the panels to be removed and re-nailed according to the nailing schedule, which is a costly process.

It is therefore a primary object of the present invention to provide a means for the workmen to mark the workpeice according to the nailing schedule in a precise manner that eliminates guesswork.

Another object is to provide a simple, handheld device that may be carried in a toolbox or on the workmen's belt.

Yet another object is to provide color changes by changing the color of the marker to notify the workmen that a specific color, such as red, means 2 inch centers, while green might be 3 inch centers, etc.

Another important object is to provide at least two different patterns on each wheel which is accomplished by turning the wheel over.

Still another object is to provide a guide on the device which is adjustable and which determines the distance of the row of nails from its edge.

Yet another object is to provide a guide on the device which is removable to allow the device to be used in the center of the board.

Another important object is to provide two wheels which cover the basic requirements of the nailing schedules which are 2, 3, 4 or 6 inches.

Still another object is to provide a marking device which is hand friendly and does not require a cumbersome handle.

Yet another object is to provide an easily constructed device that has only one moving part, namely, the roller.

Other objects and advantages will become apparent when taken into consideration with the following drawings and specifications.

DETAILED DESCRIPTION OF THE PREFERRED EMBODIMENT

Figure 1:
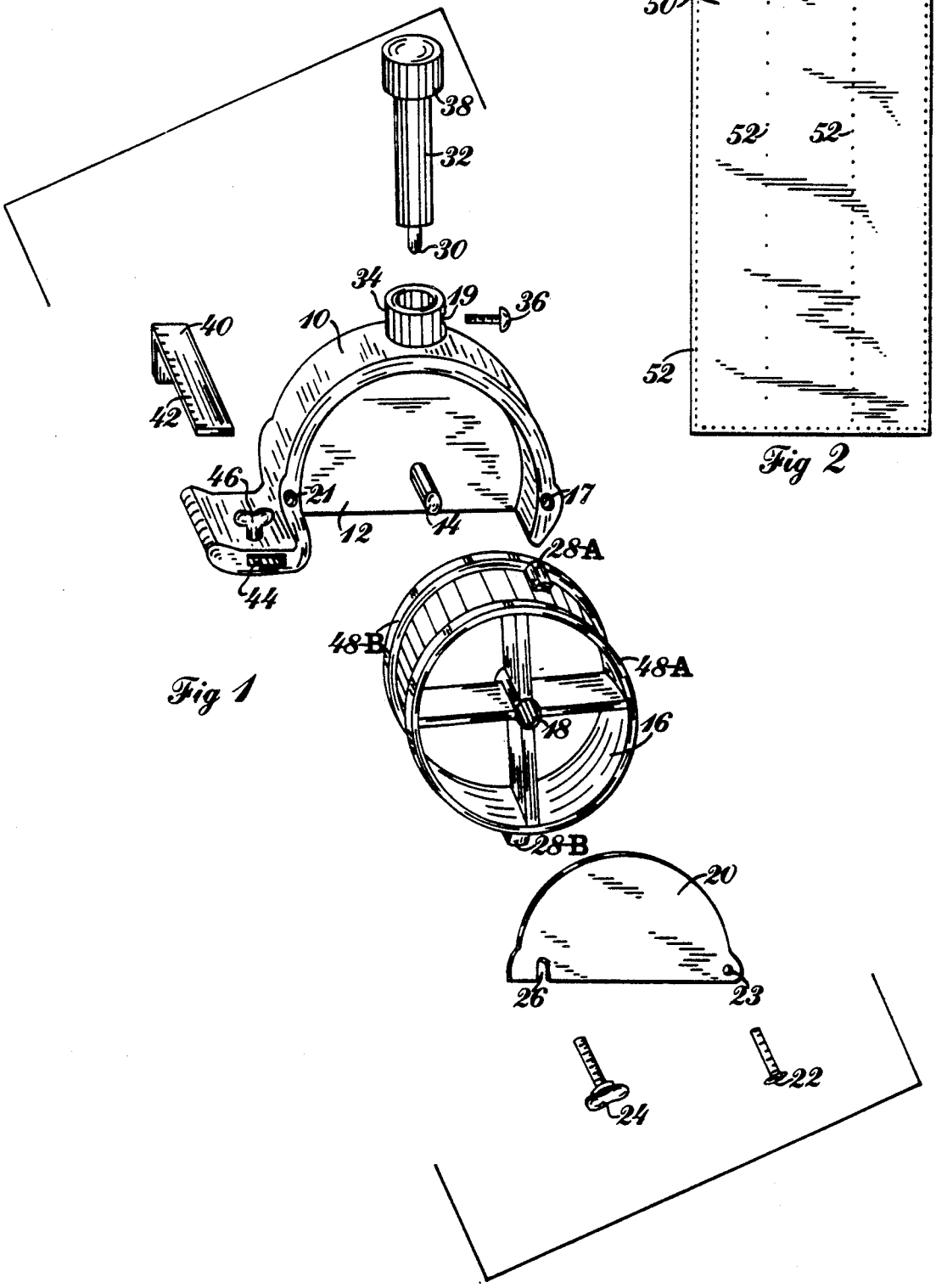
FIG. 1 is an exploded, perspective view.
Figure 2:
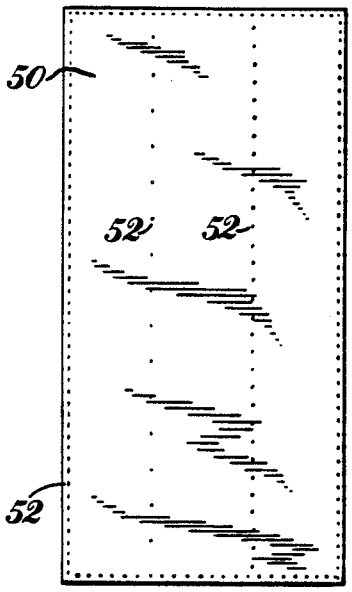
FIG. 2 is a top view of a 4×8 foot sheet of material showing the markings made by the device.
Figure 3:
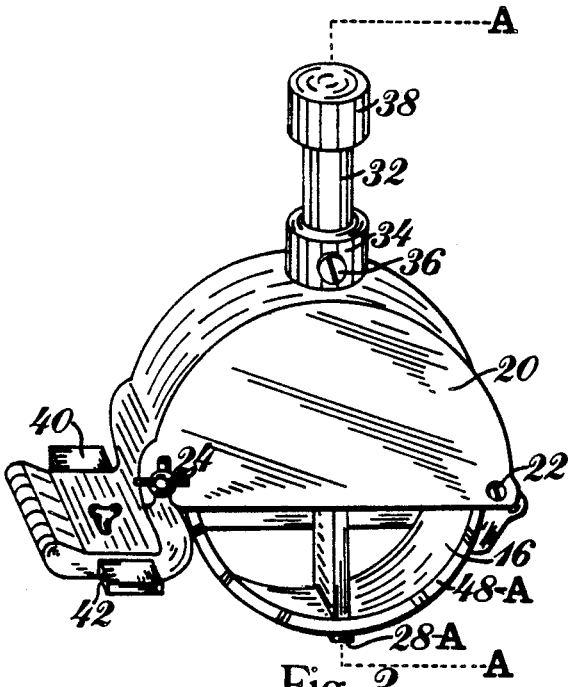
FIG. 3 is a perspective view.
Figure 4:
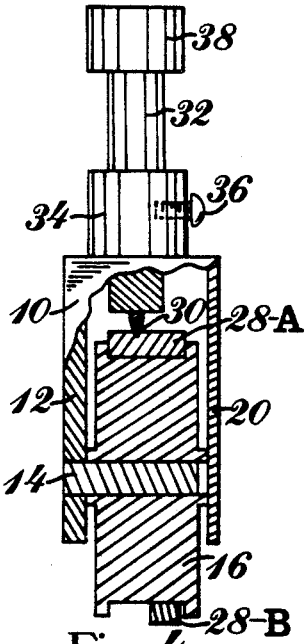
FIG. 4 is a partial cut-away view taken at A—A of FIG. 3.
Figure 5:
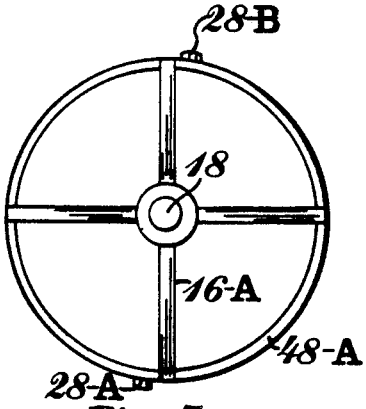
FIG. 5 is a side view of a roller.
Figure 6:
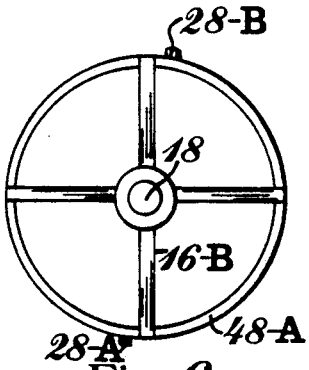
FIG. 6 is a side view of a smaller roller.
Figure 7:
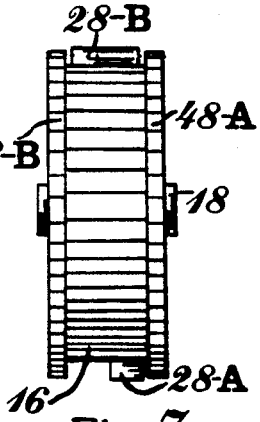
FIG. 7 is an edge view of a roller.

Referring now more particularly to the drawings wherein like numerals represent like parts, FIG. 1 shows a marking apparatus in an exploded view including a frame generally designated at 10, with 12 being a side wall acting as a mount for shaft 14, while 16 is a wheel with bearing 18, bearing 18 cooperating with shaft 14, wheel 16 being held in place by cover plate 20, mounting hole 23, threaded screw hole 17, threaded screw hole 21, thumb screw 24 and slot 26. 28-A and 28-B are protrusions affixed or molded to wheel 16, which engage the tip 30 of marker 32 each time the wheel 16 turns. The protrusions 28-A and 28-B are made of a material, such as felt, which will readily except the ink from marker 32, or the protrusions may be made of the same material as wheel 16, such as molded plastic. The marker 32, is held into the frame by boss 34, screw 36 and threaded screw hole 19 and may be removed and tip 30 covered with cap 38. 40 is a guide and depth gage with markings 42 and is held into the slot 44 of frame 10 by thumb screw 46. The wheel 16 also is designed with two outside rings 48-A and 48-B which act as mating surfaces which mate with the surface of the workpiece 50 to allow the wheel 16 to roll smoothly on the workpiece 50. Protrusions 28-A and 28-B, respectively, extend outwardly from the wheel 16 and are slightly higher than rings 48-A and 48-B, respectively, so that when wheel 16 is rotated, protrusions 28-A and 28-B, respectively, can come into contact with the workpiece 50. 52 are the markings left on the workpiece 50. FIG. 5 and FIG. 6 show a larger and a smaller wheel 16-A and 16-B, respectively.

MODE OF OPERATION

The guide and depth gage 40 is inserted into the slot 44 of frame 10 in either a left or right handed manner and set at a proper depth as indicated by markings 42 and locked into place by thumbscrew 46. One of the wheels 16-A or 16-B is then inserted over shaft 14 in one of two positions and held in place by cover plate 20. The felt marker 32 is now inserted into boss 34 of frame 10 and set at a depth to just touch the protrusions 28-A and/or 28-B when the wheel is rotated. The device is now positioned at one end and one edge of the workpiece and rolled smoothly along the edge, thus depositing marking fluid from the marker at regular intervals along the edge of the workpiece. Different patterns are provided by different wheels with each wheel providing two patterns.

It will now be seen that we have provided a means for the workman to mark the workpiece according to the nailing schedule as required and in a precise, timely manner that eliminates guesswork and which marks the workpiece not only in precise increments apart but also at the proper set-back from the edge of the workpiece, such as ½ inch.

We have also provided a device that can use a standard marker with a selection of colors and which can be maintained by covering the marking tip when not in use.

Also the workman Can carry the device on his work belt or in his tool box without a cumbersome handle and which is easily grasped by either the left or right hand.

Also, it will be noted that the only moving part is the roller which is interchangeable.

Although the invention has been shown and described in what is conceived to be the most practical and preferred embodiment, it is recognized that departures may be made therefrom within the scope and spirit of the invention, which is not to be limited to the details disclosed herein but it is to be accorded the full scope of the claims so as to embrace any and all equivalent devices and apparatus.

Having described our invention, what we claim as new and desire to secure by Letters Patent is:

1. A marking apparatus for marking a workpiece into increments comprising; an open bottom housing, said housing being substantially in the form of a half-circle, said housing having first and second side walls, said first side wall having a shaft secured to substantially its center portion, a marking drum rotatably mounted on said shaft, spacing means spacing said marking drum from said first and second side walls, said second side wall being removably secured to said housing, a marking means, said housing having support means to removably support said marking means, said marking drum having at least one raised projection on its outer most circumferential edge, said projection communicating with said marking means at least once each revolution of said marking drum, whereby, said housing, said marking drum, said projections and said marker cooperate together to deposit a mark on said workpiece when said drum is rotated.

2. The device of claim 1 in which said housing has guide means to position said device a given distance from the edge of said workpiece.

3. The device of claim 2 in which said guide means is adjustable.

4. The device of claim 1 in which said marking drum has a first and second projection on its outermost circumferential edge, said marking drum having a first and second position, whereby when said marking drum is in its said first position, said marking means is in communication with said first projection once each revolution and when said marking drum is in its said second position said marking means is in communication with said first and second projection once each revolution.

5. The device of claim 1 in which said marking means is a fluid in a reservoir, said reservoir including a sealed container having an outlet opening on one of its ends, said sealed container being slidably disposed within said support means of said housing, whereby, said outlet opening can adjustably contact said projection on said marking drum at least once every revolution of said marking drum.

6. The device of claim 5 in which said sealed container has a removable cover on said outlet opening.

7. The device of claim 1 in which said marking drum has rings on its outer circumferential edges, said rings being of a height less than said projections.

8. The device of claim 1 in which said second side wall is pivotably mounted to said housing.

9. The device of claim 1 in which said second side wall is pivotably mounted and has locking means.

10. The device of claim 5 in which said fluid is of different colors.

11. The device of claim 1 in which said increments, are 2,3,4, and 6 inches.

12. The device of claim 1 in which said housing, and said marking means cooperate together to deposit said fluid on said projection on at least two sizes of said marking drums.

13. The device of claim 2 in which said guide means is removable.

14. The device of claim 2 in which said guide means has measuring indicia.

15. The device of claim 2 in which said guide means is adaptable for either right or left hand use.

16. The device of claim 1 in which said apparatus is of a size readily held in a workman's hand.

* * * * *